US006325595B1

(12) United States Patent
Breeze-Stringfellow et al.

(10) Patent No.: US 6,325,595 B1
(45) Date of Patent: Dec. 4, 2001

(54) HIGH RECOVERY MULTI-USE BLEED

(75) Inventors: Andrew Breeze-Stringfellow, Montgomery; Peter N. Szucs, West Chester; Peter J. Wood, Cincinnati, all of OH (US)

(73) Assignee: General Electric Company, Cincinnati, OH (US)

( * ) Notice: Subject to any disclaimer, the term of this patent is extended or adjusted under 35 U.S.C. 154(b) by 0 days.

(21) Appl. No.: 09/535,935

(22) Filed: Mar. 24, 2000

(51) Int. Cl.[7] ..... F01D 13/00
(52) U.S. Cl. ..... 415/144
(58) Field of Search ..... 415/145, 144, 415/115, 116; 60/39.07

(56) References Cited

U.S. PATENT DOCUMENTS 3,945,759 * 3/1976 Bobo ..... 415/145
4,156,344 * 5/1979 Cuthbertson et al. ..... 60/226 R
4,248,566 2/1981 Chapman et al. .
5,155,993 * 10/1992 Baughman et al. ..... 60/226
5,209,633 5/1993 McGreehan et al. .
5,351,478 10/1994 Walker et al. .
5,680,754 10/1997 Giffin et al. .
6,109,868 * 8/2000 Bulman et al. ..... 415/144

* cited by examiner

*Primary Examiner*—Edward K. Look
*Assistant Examiner*—James M McAleenan
(74) *Attorney, Agent, or Firm*—Andrew C. Hess; Nathan D. Herkamp

(57) ABSTRACT

A compressor air bleed assembly for a gas turbine engine includes a compressor casing surrounding a row of circumferentially spaced compressor blades and defining a flowpath for receiving compressor air flow compressed by the blades. The casing includes a bleed port disposed down stream of at least a row of the blades for receiving a portion of compressed air as bleed airflow. A bleed port, preferably in the form of an annular slot, extends away from the bleed port and has a first throat downstream of the port and a second throat downstream of the first throat. A first duct outlet in the duct leads to a first bleed air circuit, receives a first portion of the bleed airflow, and is disposed between the first and second throats. A second duct outlet in the duct leads to a second bleed air circuit, receives a second portion of the bleed circuit.

22 Claims, 6 Drawing Sheets

HIGH RECOVERY MULTI-USE BLEED

BACKGROUND OF THE INVENTION

1. Field of the Invention

This invention relates to gas turbine engine compressor bleed and, more particularly, to bleed ports in the compressor for extracting two or more portions of compressor air from a single stage of the compressor.

2. Discussion of the Background Art

Gas turbine engines, such as a bypass turbofan engine, bleed or extract air between stages of a multi-stage axial compressor for various purposes. The extracted air is often referred to as secondary air. Secondary air is usually required for turbine cooling, hot cavity purging or turbine clearance control and is often referred to as domestic bleed because it is used for the engine. Secondary air is also often required to pressurize the aircraft cabin and for other aircraft purposes and, is thus, referred to as customer bleed. Domestic bleed flow levels are generally a constant percentage of compressor flow (i.e. 2%), whereas customer bleed requirements typically vary (i.e. 0–10%).

It is frequently desirable to have both customer and domestic bleed extracted from the same stage of the compressor, where the air has the desired pressure and temperature properties. This is, typically, desirable in a gas turbine engine having a low number of stages in the high pressure ratio compressor. The problem that this poses is to design a bleed system that allows the customer bleed to be modulated with minimal impact on the bleed pressure supplied to domestic bleed. If the domestic bleed pressure is allowed to drop below a threshold level, then, insufficient cooling air may be supplied to the hot section of the engine, resulting in decreased life on hot parts.

Conventional engines are designed with the customer and the domestic bleed ports isolated at different stages of the compressor and, thus, the domestic bleed pressure is relatively insensitive to the customer bleed rate. A high recovery bleed slot to supply both the customer and domestic bleeds has been used in engines with a low number of high pressure compressor stages. The problem with two bleed circuits using the same slot and plenum is that the slot recovery and, hence, the plenum pressure is very sensitive to the level of customer bleed.

At high levels of customer bleed, the bleed slot throat and exit Mach numbers become high and large dump losses are realized at the slot exit into the plenum. This significantly reduces the pressure available to the domestic bleed circuit. It is, thus, highly desirable to have a means for bleeding air from a compressor for two or more different air circuits, such as the customer and domestic bleeds, and being able to modulate one of the circuits with minimal impact on the bleed pressure supplied to the bleed for the other circuit or circuits.

SUMMARY OF THE INVENTION

A compressor air bleed assembly for a gas turbine engine includes a compressor casing surrounding a row of circumferentially spaced compressor blades extending from a rotatable shaft and defining a flowpath for receiving compressor airflow compressed by the blades. The casing includes a bleed port disposed downstream of at least a row of the blades for receiving a portion of the compressed air as bleed airflow. A bleed duct, preferably in the form of an annular slot, extends away from the bleed port and duct has a first throat downstream of the port and a second throat downstream of the first throat. A first duct outlet in the duct leads to a first bleed air circuit, receives a first portion of the bleed airflow, and is disposed between the first and second throats. A second duct outlet in the duct leads to a second bleed air circuit, receives a second portion of the bleed airflow, and is disposed downstream of the second throat.

In a preferred embodiment, the second throat is smaller than the first throat and the first throat has a first throat area sized such that at a maximum compressor bleed flow to the first and the second bleed circuits a first Mach number M1 at the first throat is approximately equal to an average axial Mach number MA at a vane trails edge TE of an airfoil directly upstream of the port. A second throat area of the second throat is sized such that during operation with a maximum amount of the customer bleed flow portion being extracted the diffusion in the domestic bleed flow is not excessive i.e there is no separation along an aft surface of the annular slot.

In one particular embodiment, the first bleed air circuit is a customer bleed air circuit and the second bleed air circuit is a domestic bleed air circuit of the gas turbine engine and a valve is disposed in the customer bleed air circuit downstream of the first throat. The first inlet leads to a first plenum in the first circuit and the second inlet leads to a second plenum in the second circuit. In a yet more particular embodiment, a diffuser is located between the second throat and the second duct outlet. The valve is preferably disposed in piping in the customer bleed air circuit downstream of the first plenum.

BRIEF DESCRIPTION OF THE DRAWINGS

The novel features believed characteristic of the present invention are set forth and differentiated in the claims. The invention, together with further objects and advantages thereof, is more particularly described in conjunction with the accompanying drawings in which:

DETAILED DESCRIPTION

Figure 1:
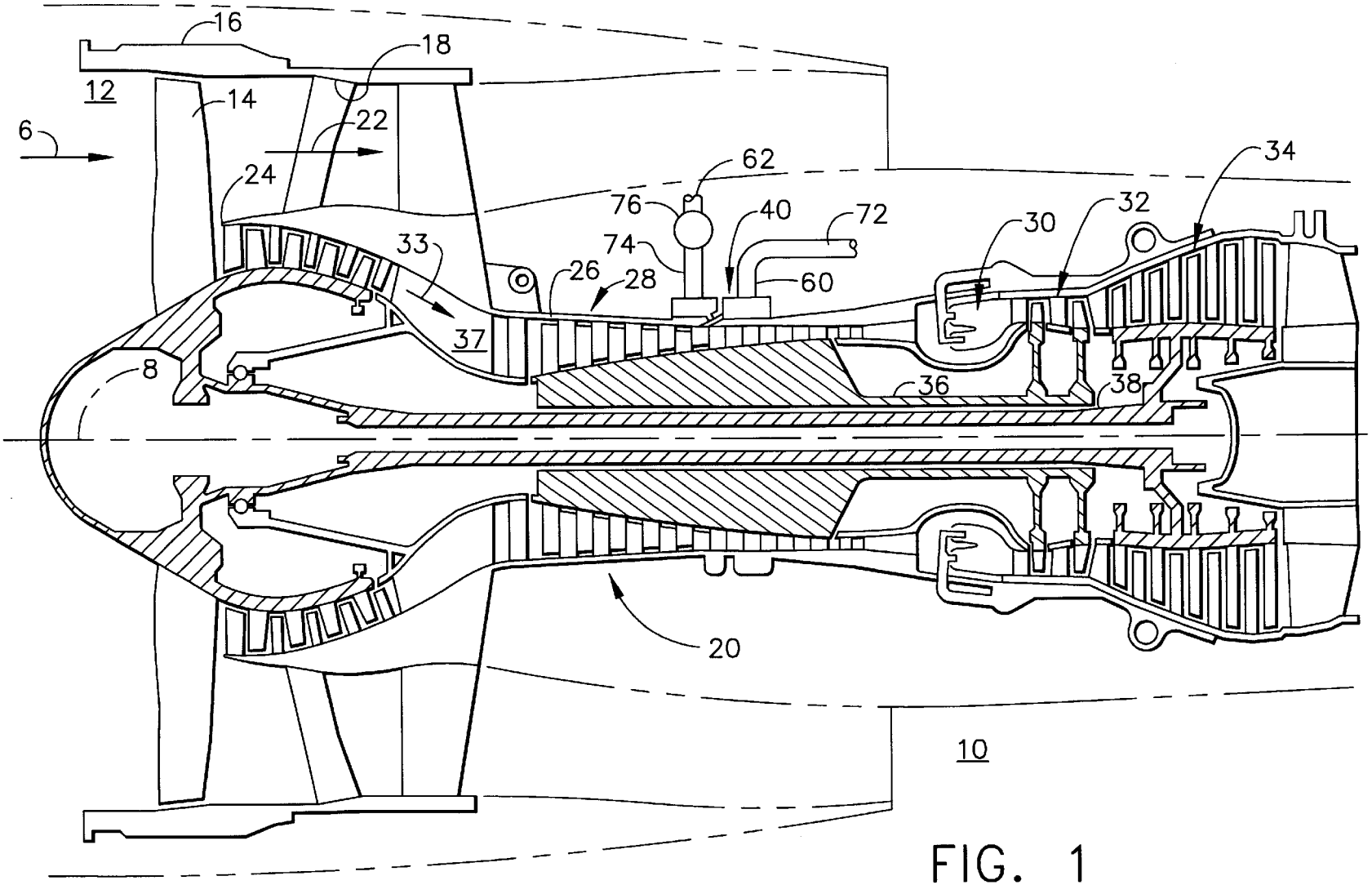
FIG. 1 is a schematic cross-sectional view illustration of a gas turbine engine having a high pressure compressor section with an exemplary embodiment of a multi-circuit bleed of the present invention.

Illustrated in FIG. 1 is an exemplary aircraft bypass turbofan gas turbine engine 10. The engine 10 includes a longitudinal centerline axis 8 and a conventional annular inlet 12 for receiving ambient air flow 6. A conventional fan 14 is disposed in the inlet 12 and spaced radially outwardly from and surrounding the fan 14 is a fan casing 16 which in part defines a bypass duct 18 aft of the fan. An annular outer casing 26 surrounds a core engine 20 and the outer casing includes a leading edge splitter 24 which divides the ambient air flow 6 after it passes through the fan 14 into bypass air 22 flow which flows through the bypass duct and core engine air flow 33 which flows through a core engine flowpath 37 of the core engine 20. The core engine 20 includes a high pressure compressor (HPC) 28, combustor 30, high pressure turbine (HPT) 32, and low pressure turbine (LPT) 34. The HPT 32 drives the HPC 28 through a first rotor shaft 36 and the HPC compresses the core engine air flow 33. The LPT 34 drives the fan 14 through a second rotor shaft 38.

Figure 2:
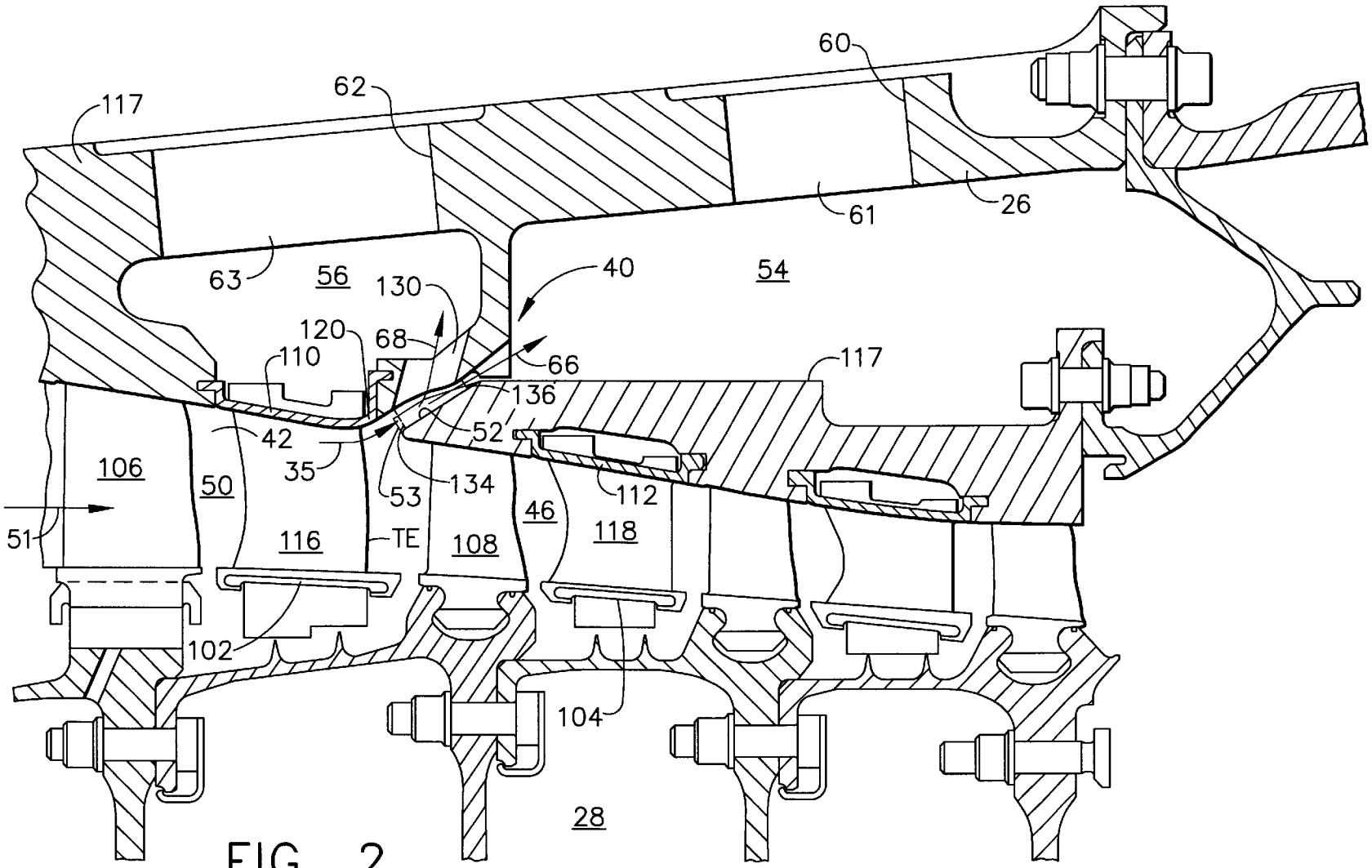
FIG. 2 is a schematic cross-sectional view illustration of a gas turbine engine high pressure compressor section, as illustrated in FIG. 1, with an exemplary embodiment of a multi-circuit bleed of the present invention.
Figure 3:
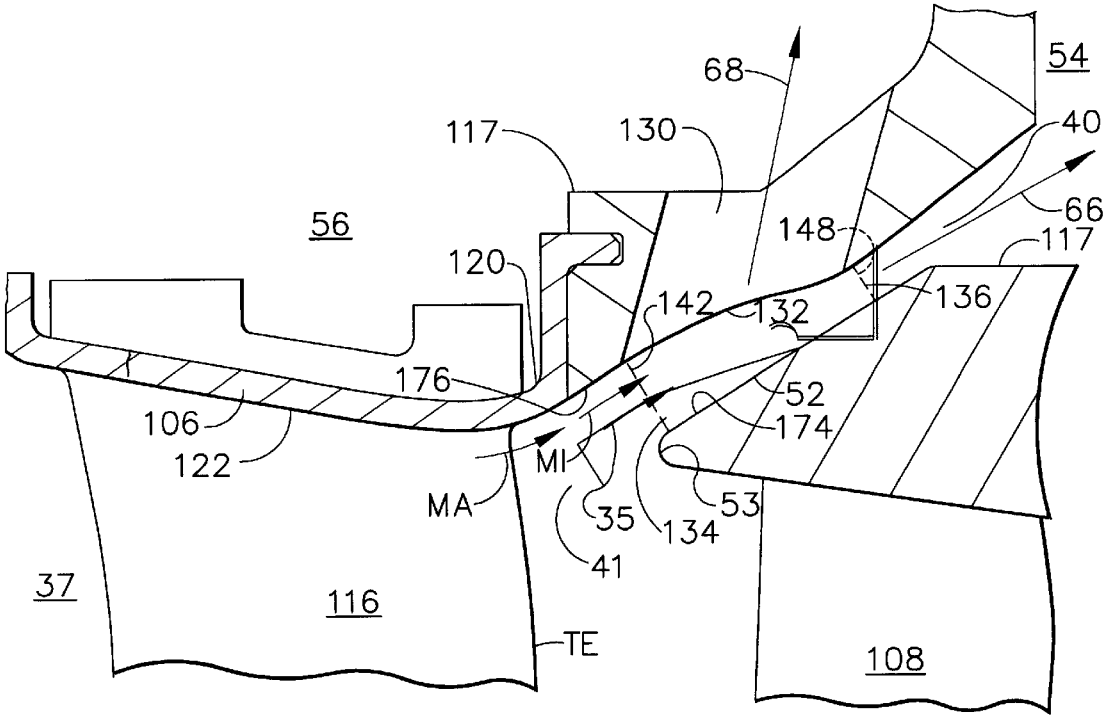
FIG. 3 is an enlarged simplified illustration of the multi-circuit bleed of the present invention illustrated in FIG. 2.

Referring to FIG. 2, disposed between intermediate stages of the HPC 28 is a compressor bleed assembly 40 having a bleed port 41 between intermediate axially adjacent first and second stages 42 and 46, respectively, such as fifth and sixth stages in the HPC of a CFM-56 aircraft gas turbine engine. In the preferred embodiment, the bleed port 41 is an inlet to a bleed duct in the form of an annular slot 52. The annular slot 52 is disposed circumferentially around the centerline axis 8 (in FIG. 1) for extracting compressor bleed flow 35 from the compressor flow 51 in the compressor flowpath 50 between the intermediate first and second stages 42 and 46. The annular slot 52 is in fluid flow communication with first and second plenums exemplified as customer and domestic bleed plenums 56 and 54, respectively.

First and second bleed circuits, exemplified as customer and domestic bleed circuits 62 and 60, respectively, and denoted in FIG. 2 by domestic and customer outlets 61 and 63, respectively, from domestic and customer bleed plenums 54 and 56, respectively. The domestic and customer bleed circuits 60 and 62 are supplied with second and first portions of the compressor bleed flow 35, exemplified as a domestic and customer bleed flow portions 66 and 68, respectively. The domestic and customer bleed flow portions 66 and 68 are flowed from the domestic and customer bleed plenums 54 and 56 to the domestic and customer bleed circuits 60 and 62 though domestic and customer bleed piping 72 and 74, respectively, as illustrated in FIG. 1. The domestic bleed flow portion 66 is generally supplied at a constant percentage of compressor flow of the core engine air flow 33 which is typically about 2 percent of the core engine air flow. The customer bleed flow portion 68 typically varies during an aircraft mission or flight between 0 and about 10 percent of the core engine air flow 33. The customer bleed flow portion 68 is varied or modulated by a valve 76 in the customer bleed piping 74.

Referring to FIGS. 2, 3, 4, and 5, the intermediate first and second stages 42 and 46, respectively, include first and second stator vanes 102 and 104 and first and second blades 106 and 108, respectively. First and second stator vanes 102 and 104 have first and second airfoils 116 and 118 that are fixedly attached to radially outer first and second vane platforms 110 and 112, respectively. The first and second vane platforms 110 and 112 are attached to an annular inner casing 117 and define a radially outer boundary of a compressor flowpath 50 containing compressor flow 51. An aft end 120 of the first vane platform 110 is smoothed and rounded and extends away from the core engine flowpath 37 into the annular slot 52. The rounded, or curved, vane platform 110 reduces discontinuities as air flows through the annular slot 52. An annular bleed port splitter 53 of the annular slot 52 is disposed slightly radially inwardly of a radially outer tip 122 of the first airfoil 116.

Figure 8:
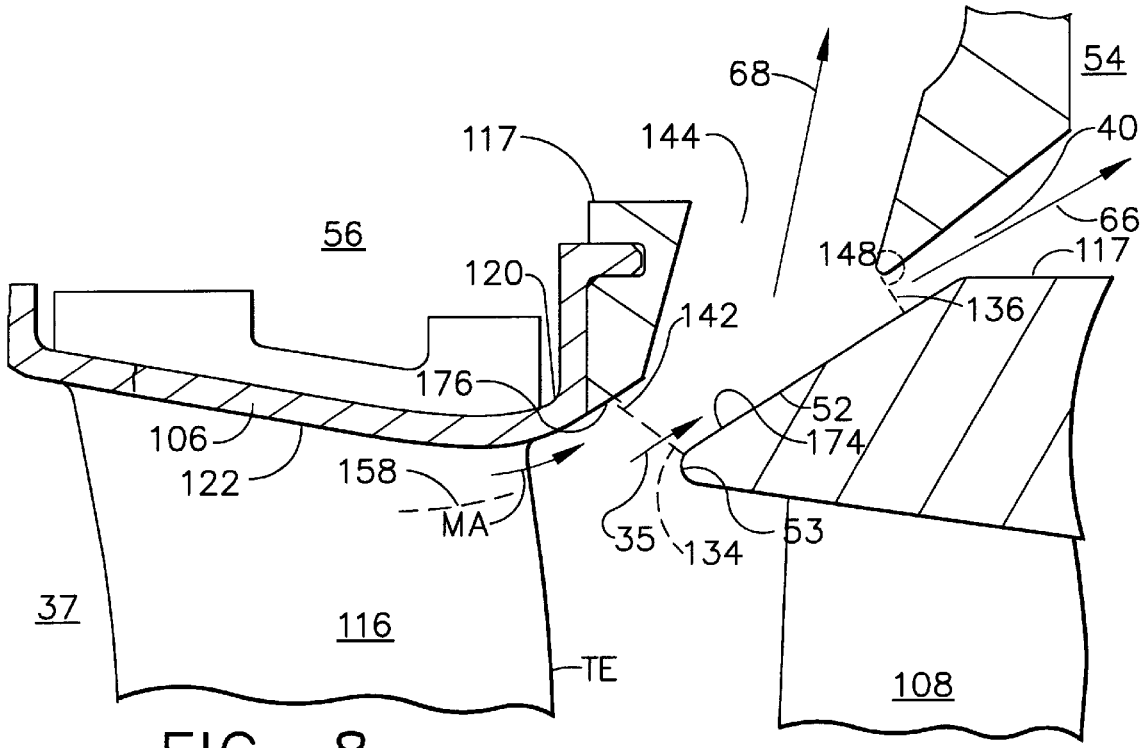
FIG. 8 is a schematic cross-sectional view illustration of a gas turbine engine high pressure compressor section with a second exemplary embodiment of the multi-circuit bleed of the present invention.

A first throat 134 is located in the annular slot 52 near the annular bleed port. The customer bleed flow portion 68 is extracted from the compressor bleed flow 35 through a first duct outlet which is a customer bleed outlet in the annular slot 52 illustrated as circular opening 132 located between the first throat 134 and a second throat 136 downstream of the first throat with respect to the compressor bleed flow 35 in the annular slot. Cylindrical passageways 130 in the annular inner casing 117 lead to the customer bleed plenum 56 from the customer bleed outlet. Each of the cylindrical passageways 130 extends from one of the circular openings 132 in the annular slot 52. Downstream of the second throat 136 at a downstream end of the annular slot 52 is second duct outlet which is a domestic bleed outlet from the annular slot, illustrated as an annular opening 140 to the domestic bleed plenum 54. A short diffuser 141 is located downstream of the second throat 136 to improve the static pressure recovery in the domestic bleed plenum 54. Illustrated in FIG. 8 is an annular diffusing slot 144 which is one alternative to the cylindrical passageways 130.

A first throat area 142 of the first throat 134 is sized such that at the maximum combined bleed flow of both the domestic and customer bleed circuits 60 and 62, which is the compressor bleed flow 35 which in turn is the sum of the domestic and customer bleed flow portions 66 and 68, a first Mach number M1 at the first throat is approximately equal to the average axial Mach number MA at a vane trailing edge of the first airfoil 116. A second throat area 148 of the second throat 136 is sized such that during operation with a maximum amount of the customer bleed flow portion 68 being extracted the diffusion in the domestic bleed flow is not excessive i.e there is no separation in the annular slot 52 along the aft surface 174 of the annular slot. The second throat area 148 is always less than the first throat area 142.

The major benefit of the present invention is that the recovery of the stator trailing edge dynamic head of the compressor bleed flow 35 at a trailing edge TE of the first airfoil 116 (of the first stator vane 102) from the domestic bleed flow portion 66 in the domestic bleed plenum 54 substantially independent of the amount of the customer bleed flow portion 68 extracted from the compressor bleed flow 35 and into the customer bleed plenum 56 for the customer bleed circuit 62. Furthermore, because the annular bleed port 41 is being purged at all times, the chance for backflow to occur from the annular bleed port back into the compressor flowpath 50 under circumferentially varying static pressure conditions is minimized. Circumferentially varying static pressure conditions typically occur when the compressor is operating with circumferential inlet distortion.

Figure 5:
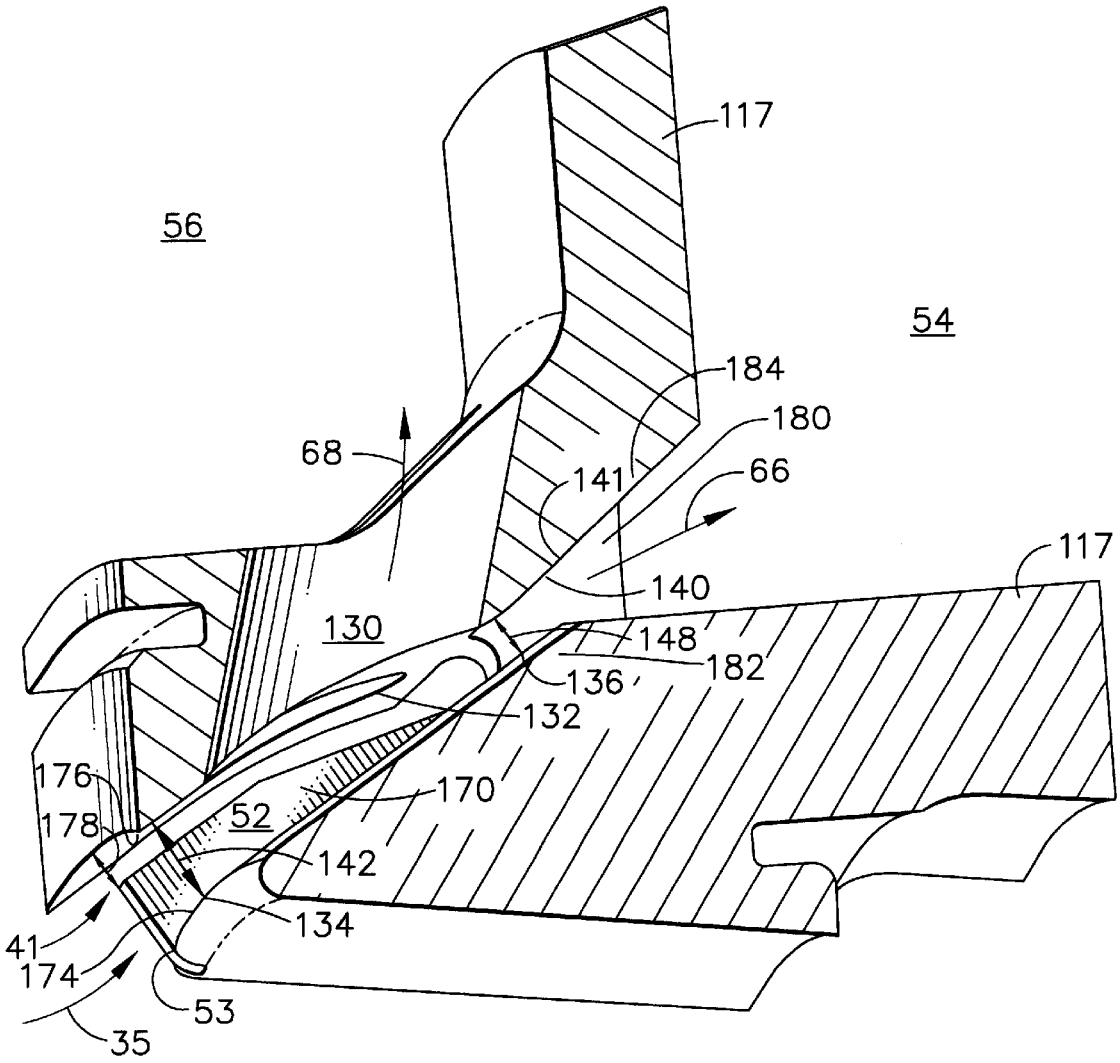
FIG. 5 is a generally circumferentially and radially outward perspective view illustration of segment of the annular bleed slot illustrated in FIG. 4.

Referring to FIG. 5, a plurality of axial vanes 170 extend up from the aft surface 174 towards a forward surface 176 of the slot 52. There is a gap 178 between the axial vanes 170 and the forward surface 176 of the slot 52. The axial vanes 170 prevent or discourage flow in a circumferential direction in the slot 52. The gap 178 is to accommodate thermal growth. A plurality of bumpers 180 extend between radially inner and outer portions 182 and 184, respectively, of the annular inner casing 117 to maintain concentricity of the radially inner and outer portions and the annular opening 140.

Figure 6:
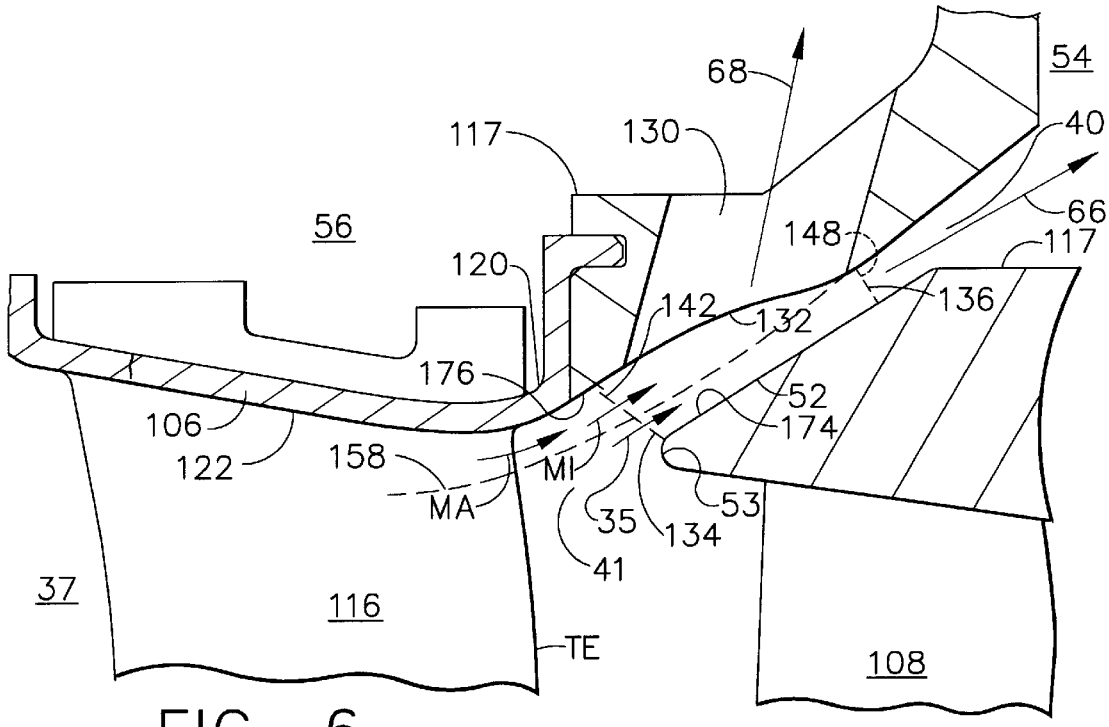
FIG. 6 is the schematic cross-sectional view illustration of the multi-circuit bleed illustrated in FIG. 1 with approximate splitting streamline between domestic and customer plenums flows to the domestic and customer plenums in the bleed under engine operating conditions having a maximum bleed being extracted from the customer plenum.
Figure 4:
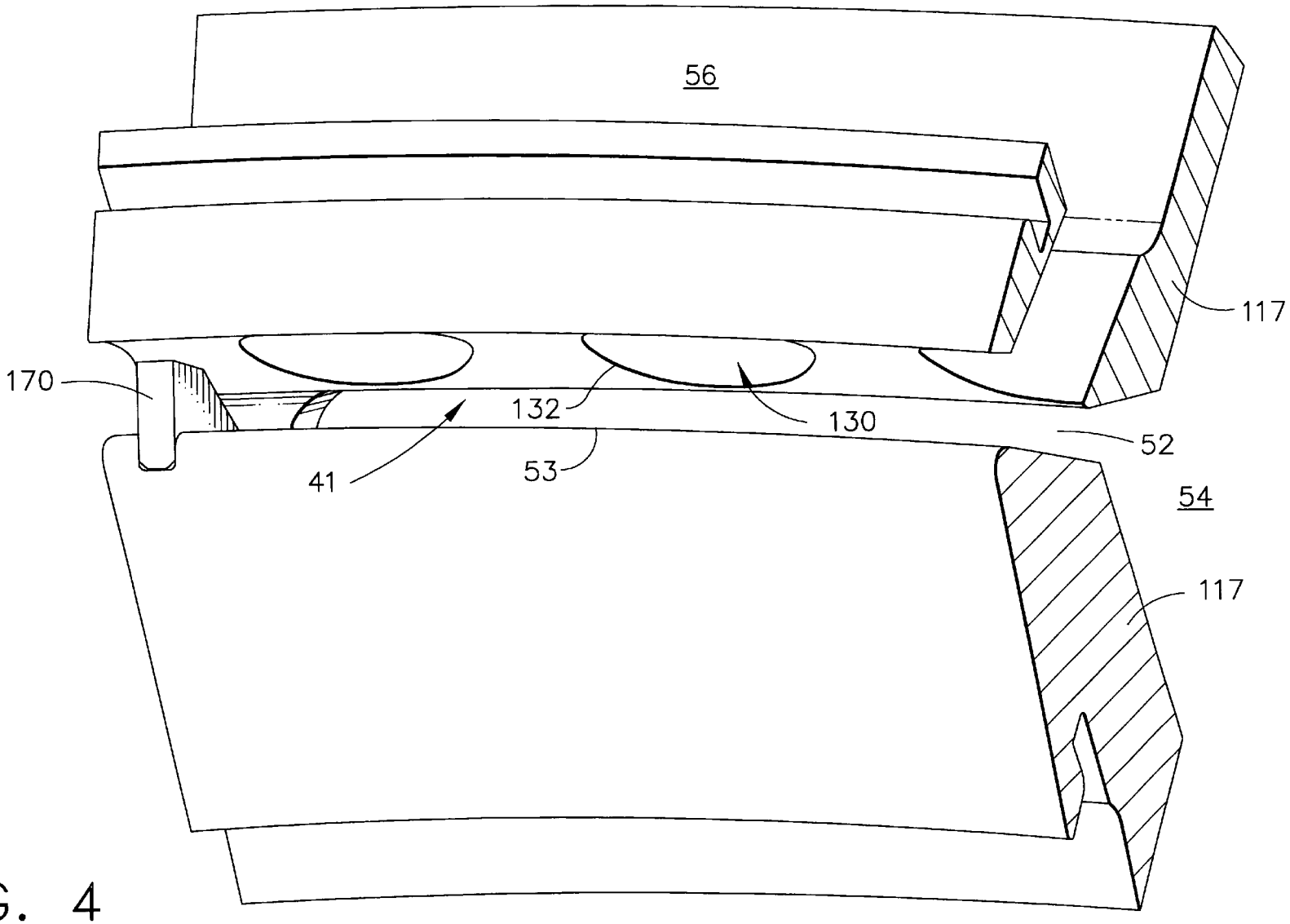
FIG. 4 is a generally aft and radially outward looking perspective view illustration of an annular bleed slot in the multi-circuit bleed illustrated in FIG. 2.

FIG. 6 illustrates how the compressor bleed assembly 40 operates with a maximum amount of the customer bleed flow portion 68 being extracted through the customer bleed plenum 56 for the customer bleed circuit 62. The dotted line represents the approximate splitting streamline 158 between the domestic and customer bleed flow portions 66 and 68, respectively. This provides a reasonable flow area distribution and good dynamic pressure recovery from the domestic bleed flow portion 66 in the domestic bleed plenum 54. The flow area distribution into the customer bleed plenum 56 is reasonable although a fairly high turning loss will result from the cylindrical hole configuration illustrated herein.

Figure 7:
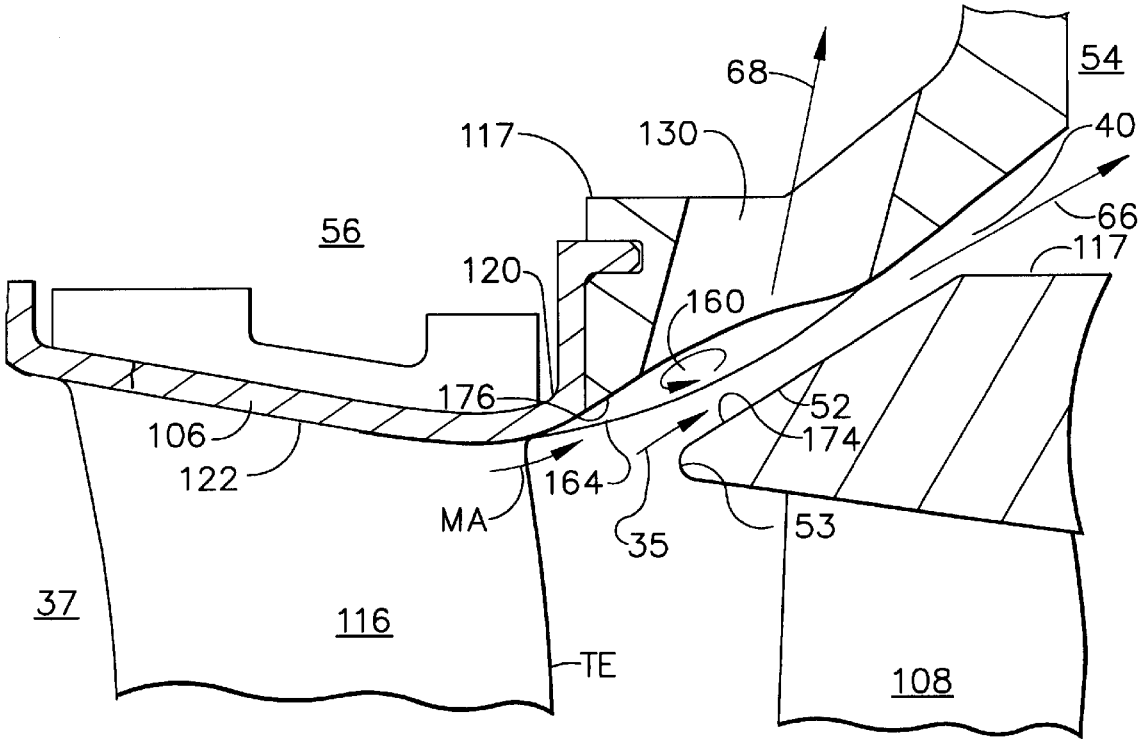
FIG. 7 is the schematic cross-sectional view illustration of the multi-circuit bleed illustrated in FIG. 1 with approximate splitting streamline and recirculation zone between domestic and customer bleed flows to the domestic and customer plenums in the bleed under engine operating conditions having substantially no bleed being extracted from the customer plenum.

FIG. 7 illustrates how the compressor bleed assembly 40 operates with substantially none of the customer bleed flow portion 68 being extracted through the customer bleed plenum 56 and used for the customer bleed circuit 62. In this case, the compressor bleed flow 35 separates from the forward surface 176 of the slot 52 and a stable trapped vortex 160 is formed as a result of the rapid area convergence into the second throat 136. A blockage due to the vortex 160 reduces an effective area of the first throat 134 and creates a false wall diffuser 164 having a reasonable area distribution and providing good dynamic pressure recovery from the domestic bleed flow portion 66 in the domestic bleed plenum 54.

While there have been described herein, what are considered to be preferred and exemplary embodiments of the present invention, other modifications of the invention shall be apparent to those skilled in the art from the teachings herein and, it is, therefore, desired to be secured in the appended claims all such modifications as fall within the true spirit and scope of the invention.

Accordingly, what is desired to be secured by Letters Patent of the United States is the invention as defined and differentiated in the following claims:

What is claimed is:

1. A compressor air bleed assembly for a gas turbine engine comprising:

a compressor casing for surrounding a row of circumferentially spaced compressor blades extending from a rotatable shaft and defining a flowpath for receiving compressor airflow compressed by said blades;

said casing including a bleed port disposed downstream of at least a row of said blades for receiving a portion of said compressed air as bleed airflow;

a bleed duct extending away from said bleed port, said bleed duct having a first throat downstream of said port and a second throat downstream of said first throat;

a first duct outlet in said duct leading to a first bleed air circuit, said first duct outlet for receiving a first portion of said bleed airflow, and said first duct outlet disposed between said first and second throats; and a second duct outlet in said duct leading to a second bleed air circuit, said second duct outlet for receiving a second portion of said bleed airflow, and said second duct outlet disposed downstream of said second throat.

2. An assembly according to claim 1 wherein said second throat is smaller than said first throat.

3. An assembly according to claim 1 wherein said first throat has a first throat area sized such that at a maximum compressor bleed flow to said first and said second bleed circuits a first Mach number at said first throat is approximately equal to an average axial Mach number at a vane trailing edge of an airfoil directly upstream of said port.

4. An assembly according to claim 3 wherein said bleed duct further comprises an aft surface and a forward surface and said second throat has a second throat area sized such that during operation with a maximum amount of the customer bleed flow portion being extracted there is no separation along said aft surface.

5. An assembly according to claim 1 wherein said bleed duct is an annular slot.

6. An assembly according to claim 1 wherein said first bleed air circuit is a customer bleed air circuit and said second bleed air circuit is a domestic bleed air circuit of the gas turbine engine.

7. An assembly according to claim 6 further comprising a valve disposed in said customer bleed air circuit downstream of said first throat.

8. An assembly according to claim 7 wherein said first throat has a first throat area sized such that at a maximum compressor bleed flow to said first and said second bleed circuits a first Mach number at said first throat is approximately equal to an average axial Mach number at a vane trailing edge of an airfoil directly upstream of said port.

9. An assembly according to claim 8 wherein said annular slot further comprises an aft surface and a forward surface and said second throat has a second throat area sized such that during operation with a maximum amount of the customer bleed flow portion being extracted there is no separation along said aft surface.

10. An assembly according to claim 9 wherein said bleed duct is an annular slot.

11. An assembly according to claim 10 wherein said first inlet leads to a first plenum in said first circuit and said second inlet leads to a second plenum in said second circuit.

12. An assembly according to claim 11 further comprising a diffuser located between said second throat and said second duct outlet.

13. An assembly according to claim 11 wherein said valve is disposed in piping in said customer bleed air circuit downstream of said first plenum.

14. An assembly according to claim 13 wherein said annular slot further comprises an annular bleed port splitter disposed slightly radially inwardly of a radially outer tip of said airfoil.

15. An assembly according to claim 14 further comprising a diffuser located between said second throat and said second duct outlet.

16. An assembly according to claim 11 wherein said first duct outlet comprises a plurality of circular openings and said assembly further comprises a plurality cylindrical passageways, each of said cylindrical passageways extending from one of said circular openings to said first plenum.

17. An assembly according to claim 16 wherein said first duct outlet comprises an annular diffusing slot.

18. An assembly according to claim 17 wherein said second duct outlet comprises an annular opening.

19. An assembly according to claim 18 further comprising a diffuser located between said second throat and said second duct outlet.

20. An assembly according to claim 19 wherein said valve is disposed in piping in said customer bleed air circuit downstream of said first plenum.

21. An assembly according to claim 20 wherein said annular slot further comprises an annular bleed port splitter disposed slightly radially inwardly of a radially outer tip of said airfoil.

22. An assembly according to claim 21 further comprising a diffuser located between said second throat and said second duct outlet.

* * * * *